United States Patent [19]

Smith et al.

[11] 4,042,036

[45] Aug. 16, 1977

[54] ELECTRIC IMPACT TOOL

[76] Inventors: James E. Smith, 217 Meadowlook Way; James D. Cunningham, 2100 Topaz, both of, Boulder, Colo. 80302

[21] Appl. No.: 580,246

[22] Filed: May 23, 1975

Related U.S. Application Data

[63] Continuation of Ser. No. 403,493, Oct. 4, 1973, abandoned.

[51] Int. Cl.[2] ..... B25C 1/06

[52] U.S. Cl. ..... 173/13; 74/125.5; 124/10; 173/121; 173/124; 173/170; 226/154; 226/186; 227/131; 227/146; 227/147

[58] Field of Search ..... 173/1, 13, 49, 53, 121, 173/93.5, 124; 29/432, 526; 74/50; 227/147, 146; 124/10; 299/14

[56] References Cited

U.S. PATENT DOCUMENTS

| | | | |
|---|---|---|---|
| 1,823,644 | 9/1931 | Cossock | 227/136 |
| 2,487,530 | 11/1949 | Dirksen | 173/124 X |
| 2,627,849 | 2/1953 | Carlson | 173/49 X |
| 2,869,824 | 1/1959 | Hazak | 173/53 |
| 3,486,569 | 12/1969 | Sieber | 173/93.5 |
| 3,583,497 | 6/1971 | Kossowski | 173/49 |
| 3,661,217 | 5/1972 | Maurer | 173/93.5 |
| 3,766,901 | 10/1973 | Cleary et al. | 124/1 |
| 3,770,322 | 11/1973 | Cobb et al. | 299/14 X |

FOREIGN PATENT DOCUMENTS

| | | | |
|---|---|---|---|
| 900,123 | 11/1945 | France | 124/1 |

*Primary Examiner*—Ernest R. Purser
*Assistant Examiner*—William F. Pate, III
*Attorney, Agent, or Firm*—Edwin L. Spangler, Jr.

[57] ABSTRACT

This invention relates to an electric impact tool characterized by a pair of electric motor-driven counterrotating flywheels, at least one of which is movable relative to the other from a retracted inoperative position into an extended operative one closely adjacent the other flywheel whereby a ram is squeezed therebetween and impelled forward at high speed against a workpiece. The nosepiece of the tool frame is retractable although normally extended due to the spring bias urging it and the movable flywheel to which it is mechanically linked into disengaged position. These elements cooperate with one another and with a manually-actuated trigger such that the latter must be depressed and the nosepiece retracted in order to engage the high energy friction clutch defined by the flywheels so as to operate the ram. A flywheel speed control is provided for matching the ram impact to the workload. The nosepiece also includes an energy absorbing cushion effective to dissipate the excess energy carried by the ram at the end of its work stroke so as to prevent damage to the structure against which the nosepiece is pressed.

34 Claims, 12 Drawing Figures

ELECTRIC IMPACT TOOL

This is a continuation, application Ser. No. 403,493, filed Oct. 4, 1973, now abandoned.

Low energy electrically-powered impact tools are quite commonplace and are used for such applications as driving small nails and staples, loosening and tightening nuts and setting deformable fasteners like small brass and copper rivets. Up to now, however, most all high energy impact tools, at least the hand held type, have been operated by compressed air. There are many obvious disadvantages to air-operated hand tools, not the least of which is the necessity for large hoses and a relatively stationary high volume air supply. The pressure regulators, lubricators, filters and the like ordinarily used with pneumatic equipment all serve to complicate the situation as well as make it more cumbersome and expensive.

While the concept of a high energy hand-held electrically-powered impact tool is, to say the least, an attractive one, it poses a number of problems which have heretofore remained unsolved. For instance, it can be demonstrated rather simply through the use of an arbor press and a scale that a peak force of about 1000 lbs. is required to drive a 16 penny (3.25 inches) nail into semi-hard wood up to the point where its head lies flush with the surface of the latter. Since the nail obviously exerts an equal and opposite force on the driver and the operator could not possibly oppose a 1000 lb. peak force, a low velocity driver will not work regardless of the force developed thereby as it would merely be pushed back away from the workpiece rather than forcing the nail through it. Thus, both the time required to drive the nail and the mass of the driver become mose important considerations, especially if the design parameters call for recoilless operation which is highly desirable.

Other practical parameters can be chosen for the tool such as, for example, its mass and contact velocity for the purpose of calculating the amount of latent energy that must be stored in the system as well as the type of mechanism that is required to transfer such energy to the workpiece in the brief time allotted for essentially recoilless operation. When this is done, such calculations reveal the fact that a considerable energy storage capability coupled to a very fast and efficient power transfer mechanism becomes an absolute necessity. Furthermore, such calculations reveal the utter futility of applying conventional approaches like solenoids to the solution of the problem because an electromagnetic unit capable of generating the required average power over the allotted time span would be so large and heavy as to be utterly impractical to say nothing of its cost.

The flywheel comes to mind as a mechanism which is both compact and lightweight yet, at the same time, possesses high energy storage capabilities. Unfortunately, however, it also constitutes a high speed rotating system with large undesirable precession moments that become most difficult to cope with and, in fact, almost insurmountable in a hand-held tool that must be positioned with considerable accuracy. The problems presented to the operator in coping with such forces as these make a single flywheel tool a very dangerous, if not in fact a lethal, instrument when loaded with nails or other fasteners that are ejected therefrom at high speeds because of the considerable difficulty associated with controlling same.

It has now been found in accordance with the teaching of the instant invention that a high energy electrically-driven hand-held impact tool can, in fact, be constructed that is capable of developing the 75 horsepower or so required to drive a 3 ¼ nail during a brief interval lasting a few thousandths of a second. In fact, a small fractional horsepower electric motor will be entirely adequate to answer the power requirements of a duty cycle calling for more than one actuation per second.

Not one, but a pair of substantially identical counterrotating flywheels, store the necessary energy and, in addition, when properly matched and oriented relative to one another, cooperate to cancel out the bothersome precession moments inherent in high speed rotating systems having flywheels. These same flywheels, when one is moved relative to the other so as to engage a friction ram positioned therebetween, coact to define an efficient high speed power transfer mechanism capable of imparting a considerable driving force to the ram in a matter of a few milliseconds. What's more, the clutch thus produced requires no synchronous engagement and, when properly designed, is free of slippage.

The incorporation of mechanical interlocks which require that the nose of the tool to be held firmly against the workpiece while the trigger is actuated to engage the clutch make the tool a safe one to operate while, at the same time, disabling it from discharging a fastener should it be dropped accidently. The motor speed control, while not exactly a safety feature, does provide the operator with the means by which he can reduce the ram energy to an appropriate level commensurate with the job being performed thus preventing damage to the workpiece.

Ordinary household current is entirely adequate as a power source and, in fact, the power demands are such that they could easily be supplied by batteries or a small self-contained generator, especially in the case of a low demand duty cycle. The problem becomes one of the time involved to get the flywheel drive motors up to speed rather than the dissipation of energy during the drive cycle which is minimal even with a small fractional horsepower motor.

The instant impact tool, when designed for use as a nailer, is readily adapted to accept commercially-available strips or belts of nails without modification. The same is true of other types of fasteners such as rivets and the like when similarly packaged. In general, such items would be housed in a spring-fed magazine of conventional design.

It is, therefore, the principal object of the present invention to provide a novel high energy hand-held electrically-driven impact tool.

A second objective is the provision of a device of the type aforementioned that uses the principle of a high speed flywheel as an energy storage medium yet is so designed as to be virtually free of any precession moments.

Another object of the within described invention is to provide an impact tool utilizing a matched pair of counterrotating flywheels as the energy transfer medium by means of which the latent energy stored therein is imparted almost instantaneously to the ram.

Still another objective is the provision of an impact tool having a ram operated by a self-locking virtually slipless high power friction clutch that eliminates the need for synchronous engagement inherent in toothed clutches.

An additional object is to provide an electrically-driven hand tool that is based upon a double counterrotating flywheel principle that is readily adapted to such applications as nail, rivet and staple drivers embossing tools, punches, chisels and other similar devices whose work cycle is predicated upon the high speed impact of a retractable ram.

Further objects are to provide a tool of the type herein disclosed and claimed that is lightweight, rugged, relatively inexpensive, versatile, safe, dependable, easy to operate, simple to service, powerful, efficient and even decorative.

Other objects will be in part apparent and in part pointed out specifically hereinafter in connection with the description of the drawings that follows, and in which.

Figure 1:
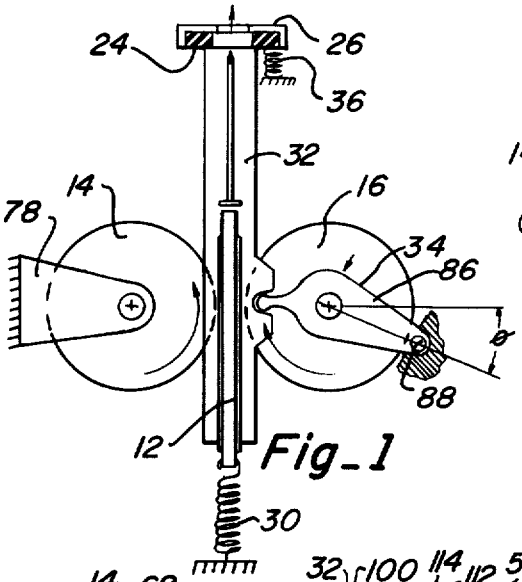
FIG. 1 is a schematic representation of the principle operating parts of the unit.

Before turning to a detailed description of a nail-driving embodiment of the present invention that has been broadly designated by reference numeral 10, reference will be made to the schematic view of FIG. 1 for the purpose of outlining the more important design features and parameters of the tool, some of which are quite critical. First of all, to get an idea of the force that must be generated by the tool and the time interval within which this force must be expended, a simple experiment coupled with a detailed mathematical analysis will be helpful.

It can be demonstrated experimentally with a simple arbor press that a 16 penny nail which is 3.25 inches long requires a peak force of about 1000 lbs. to drive it all the way up to the point where its head is flush with the surface of a piece of medium hard lumber. Furthermore, a graph of the force applied versus the degree of penetration shows a substantially linear relationship up to the 1000 lb. limit above noted. Therefore, the total energy expended ($E_o$) can be represented mathematically as follows:

Equation (1)

-continued $$E_o = \int_O^L F\,dL \approx 125 \text{ ft lbs.}$$

Since, in operation, the nail exerts an equal and opposite force upon the impact tool or driver, the time required to drive the nail and the mass of the driver become important considerations. If, therefore, we assume a 10 lb. weight for the driver which is reasonable for a hand-held tool, and we further assume a contact velocity of 5 ft./sec., the time available to insert the nail into the wood can be defined as follows where F(*t*) is the time varying force exerted on the tool by the nail, then, Equation (2) $F(t) = MA = Mdv/dt$ where M is the mass of the driver and *td* is time required to drive the nail. Accordingly, Equation (3) $F(t)/M\,dt = dv$ or, expressed another way Equation (4)

$$\frac{1}{M}\int_O^{t_d} F(t)\,dt = \int_{V_i}^{V_f} dv$$

where $V_i$ is the impact velocity of the tool and $V_f$ is its final velocity. Having already determined that Equation (5)

$$F(t) = 1{,}000\left(\frac{t}{td}\right) \text{ lbs}$$

it follows from Equation (4) that

Equation (6)

$$\frac{1000\,td}{2M} = V_f - V_i$$

Solving for *td* in Equation (6) we find

Equation (7)

$$td = \frac{2M\,(V_f - V_i)}{1000}$$

Now, substituting the assumed value of 5 ft/sec. for the impact velocity ($V_i$), a zero terminal or final velocity ($V_f$) and a mass M of 10/32, we find that Equation (8)

$$td = \frac{2\,(10/32)\,(5)}{100} = .003 \text{ sec.}$$

Accordingly, using a 10 lb. tool with an initial velocity of 5 ft/sec. and recoilless operation ($V_f$ = o), three milliseconds of time are available to drive the nail.

The average power required during the drive time *td* can be calculated as follows:

Equation (9)

$$P_{ave} = \frac{125}{550 \times .003} = 75 \text{ hp}$$

It becomes readily apparent from the above calculations that the tool must possess a considerable energy storage capability and, in addition, the ability to release said energy over a very short period of time, namely, a few milliseconds.

Now, if a flywheel adopted as the energy storage mechanism, and we use a 3 inch diameter on and assume an angular velocity of $w$, a meaningful comparison can be made between the peripheral flywheel velocity and the nail insertion speed, and the flywheel energy and required energy.

Assuming a 3 inch nail is driven in 0.003 seconds, this is a velocity of:

Equation (10)

$$\frac{3}{.003} = 1000 \text{ in/sec}$$

The angular velocity of a 3 inch flywheel with 1000 in./sec. peripheral velocity is:

Equation (11)

$$w = \frac{1000}{1.5} = 666 \text{ rad./sec.} = 106 \text{ rev. sec.} = 6366 \text{ r.p.m.}$$

This is a reasonable velocity and could be increased if necessary.

The energy of the flywheel is:

Equation (12) $E = 0.5\ I\ w^2$ where I is the angular inertia of the flywheel.

For a solid disc, 3 inch in diameter, the inertia is expressed as follows:

Equation (13) $I = 0.5mr^2$

If, for example, brass is chosen for the flywheel and it is 1 inch thick, its mass is:

Equation (14)

$$M = \frac{w}{g} = \frac{(535/1728)\ (\ /4)\ (9)\ (1)}{32} = .0684\ \frac{\text{lb. sec.}^2}{\text{ft.}}$$

Thus, substituting in Equation (13),

Equation (15) $I = 0.5\ (0.0684)\ (1.5/12)^2 = 5.34 \times 10^{-4}$ lb. ft. sec.$^2$ Using $w = 666$ rad./sec. the energy becomes:

Equation (16) $E = 0.5(5.34 \times 10^{-4})\ (666)^2 = 118.43$ ft. lb.

Having already determined that approximately 125 ft. lbs. of energy was needed to drive a 3.25 inch nail up to the head in semihard wood, it becomes apparent that a 3 inch solid brass flywheel 1 inch thick rotating 7000 r.p.m. has ample energy and peripheral velocity to satisfy the needs of a high energy nailer.

Such a tool, however, if hand held, would likely develop significant precession moments when subject to angular rotation about axes perpendicular to the flywheel spin axis. The magnitude of this moments can be calculated as follows:

Equation (17) $M_p = I\Omega w$ where $M_p$ *is the precession moment acting upon the nailer*

I is the inertia of the nailer's flywheel $w$ is the angular velocity of the flywheel $\Omega$ is the angular velocity that the operator attempts to rotate the nailer.

By way of example, assume the operator has a nailer with the previously-mentioned flywheel parameters and he attempts to reorient the nailer 180° in 0.1 sec., the resulting moment on the nailer due to gyroscopic precession is calculated as follows:

Equation (18)

$$= \frac{\pi \text{ rad.}}{.1 \text{ sec.}} = 31.4 \text{ rad./sec.}$$

Equation (19) $M_p = (31.4 \text{ rad./sec.})\ 5.34 \times 10^{-4}$ lb. ft. sec.$^2$) (666 rad./sec.) = 11.2 ft. lb.

This is a significant torque and would make it very difficult for the operator to position the nailer at any desired location.

Accordingly, two functionally identical flywheels rotating in opposite directions about parallel axes at the same speed are needed to cancel out the precession moments that are most unwelcome in a hand-held tool that must be positioned carefully and accurately relative to a workpiece. It has now been found in accordance with the teaching of the instant invention that there are a number of other, more or less critical parameters that must be reconnected with.

One of the most significant is the fact that if a ram element 12 is pinched between a pair of counterrotating flywheels 14 and 16 which drive same forwardly against a workpiece as illustrated in the diagram of FIG. 1, then no slippage of any consequence can be tolerated if, as previously noted, the entire work stroke of the ram must be completed in a few milliseconds. In other words, if the tool is to be used to drive a 16 penny nail, it must be capable of transmitting a 1000 lb. force to the ram in a 0.003 second ram engagement time.

While a driving connection between the flywheels and the ram can be accomplished in more than one way, the only practical one seems to be frictionally as it requires no synchronous engagement as would a rack and pinion and the like. Furthermore, a clutch of some nature is necessary to bring the already spinning flywheels into instant driving engagement with the ram, it being an obvious impossibility to bring the flywheels up to the required speed and drive the ram all within a few milliseconds, yet, such would be necessary if the flywheels stayed in driving engagement therewith.

Now, such a clutch could either operate to shift both flywheels toward and away from one another to engage and disengage the flywheel or, alternatively, only on need more relative to the other, the movable one engaging the ram and pushing it sideways against the fixed one. Of the two, the latter approach is much to be preferred over the former for the reason that if the ram floats between two relatively movable flywheels, one will reach it ahead of the other each actuation rather than simultaneously. As this happens one flywheel of the pair will have to yield to the other in which the overbalancing force is present. It can be shown that these ram engaging forces are of the order of three times the force necessary to drive the nail, i.e., 3000 lbs. as compared with 1000 lbs; therefore, a yieldable flywheel mounting system becomes a most difficult mechanism to properly design and engineer. Furthermore, one is never sure what path the ram will follow on its forward excursion or work stroke as it may be on either side of its guideways depending upon which of the two flywheels has taken precedence over the other on the particular actuation. For the reasons above noted, one flywheel mounted for rotaton about a fixed spin axis and clutch attached to the other operative upon actuation to narrow the gap therebetween is much the better way of solving the problem.

While it is certainly possible to shift the movable flywheel toward the fixed one along a line perpendicular to the direction of ram travel into its extended position, developing a ram-engaging force nearly three times the maximum work force developed in the ram becomes a serious problem. It has been found, however, that ram-gripping forces of sufficient magnitude can easily be developed by swinging the movable flywheel arcuately into engagement about an axis of pivotal movement lying to the rear of its spin axis. As the surface of the movable flywheel engages the adjacent ram surface and forcesthe ram over against the surface of the fixed flywheel, its direction of rotation is such as to roll it rearwardly thereby increasing the pressure it exerts against the ram. Such flywheel action upon engagement with the opposite ram surfaces instantly and easily develops the requisite ram-gripping forces even though they exceed the maximum driving force developed in the ram by a three-fold factor.

The theoretical arcuate excursion of the movable flywheel's spin axis is back into a plane passing through its axis of pivotal movement that is perpendicular to the direction of ram travel into its extended position. Once the spin axis passes rearwardly beyond this plane, however, the clutch loosens its grip on the ram and the driving connection is lost. If the system is to accommodate even minimal wear on the mating parts, therefore, the spin axis of the arcuately movable fywheel must be stopped short of this position. How far short presents an interesting question and one that is susceptible of precise, though unobvious, solution in accordance with the teaching found herein.

The force tending to propel the ram upwardly as schematically represented in FIG. 1 can be expressed as follows:

Equation (20) $F_d = 2F_nK_f$ where $F_n$ is the normal force between the flywheel and ram surface, and $K_f$ is the coefficient of friction between the ram and flywheel. In the same diagram, the downward force on the arcuately movable flywheel 16 is:

Equation (21) $F_u = F_nK_f$

From the geometry of the system, the force

Equation (22)

$$F_n = \frac{F_u}{\text{Tan } \theta}$$

where $\theta$ is the acute angle at the intersection of a plane defined by the spin axis of the arcuately-movable flywheel and its axis of pivotal movement and a second plane perpendicular to the direction of movement of the ram 12 into extended position.

By substituting Equation (21) into Equation (22) and simplifying, unexpectedly one finds that:

Equation (23) $\text{Tan } \theta = K_f$

Thus, knowing that slippage is critical and cannot be tolerated for all practical purposes, if $K_f \leqq \tan \theta$, the flywheels will not slip once engaged with the ram. It now becomes quite simple to select the angle $\theta$ or the coefficient of friction $K_f$ so that the foregoing critical relationship is present.

Note also that the flywheels are cylindrical and the engaged faces of the ram are planar so that they mate in tangential relation making straight-line contact with one another along a line parallel to the spin axis. Other complementary surfaces are unsatisfactory and to be avoided for the reason that points thereon at different distances from the spin axis will, of necessity, have different peripheral velocities and slippage is bound to result.

A few other points are worthy of specific mention before proceeding with a detailed description of the nail-driving embodiment of the impact tool. Motor size is a consideration and it depends upon the required duty cycle. As previously noted, the average power consumed is approximately 75 hp to drive a 16 penny nail so as to bury the head flush with the surface of the workpiece. Since energy is stored in the flywheels, the actual motor size required to drive them may vary from 0–75 hp depending upon the required duty cycle. If a duty cycle of 5 actuations/sec. is chosen and friction ignored, the required motor would be:

Equation (24)

$$P_{req} = 75 \frac{(5 \times .003)}{(1)} = 1.125 \text{ hp}$$

In other words, a 1.125 hp motor could maintain flywheel speed even using five actuations per second. Obviously, this is an excessive duty cycle from a practical standpoint and it becomes quite obvious that a small fractional horsepower electric motor would be entirely adequate. Furthermore, the amount of energy dissipated per actuation is such that battery power would be quite adequate to power the motors in light to medium duty applications over moderate time spans of a few hours or so.

Figure 12:
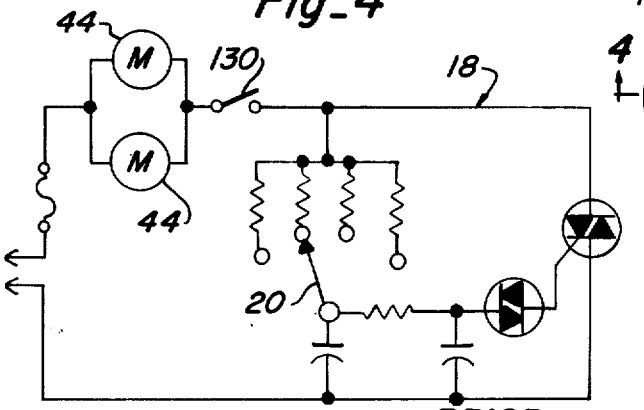
Fig 12 PRIOR ART

Excessive ram energy can be a problem and provision needs to be made for controlling same. The first of two provisions for doing so is by means of a speed control 18 for the motor or motors driving the flywheels such as that shown schematically in FIG. 12 and upon which no novelty whatsoever is predicated, it being merely representative of one such speed control that could be used. The various positions of the control knob 20 can be indexed to positions on the scale 22 (FIG. 2) that are calibrated directly in nail sizes, for example.

Since enough energy must be imparted to the ram to insure completion of the work assigned thereto, a slight excess is ordinarily employed. To avoid damaging the workpiece due to the presence of this excess energy, however, means are preferably provided for dissipating some before it can cause the ram to dent, gouge, puncture, scar or otherwise damage the workpiece. An energy-absorbing cushion 24 is placed in the nosepiece 26 on the front end of the nozzle 28 of the case effective to receive and absorb some of the excess energy left in thee ram as it nears completion of its work stroke. If, however, the ram is still being positively driven by the flywheels, such a cushion is inadequate. Accordingly, the length of the ram is preferably such in relation to the location of the flywheels behind the nosepiece that the ram has moved out of positive driven engagement therewith prior to its completing its work stroke or striking the cushion 24 as shown most clearly in FIG. 7. This means, of course, that the cushion is no longer required to absorb the direct energy being supplied to the ram by the flywheels at the end of its stroke, but only that energy left over due to its mass and velocity. Obviously, the lighter the ram, the less residual energy it has at the end of its stroke, all other factors being equal.

At the instant the ram moves forward beyond the flywheels and becomes disengaged therefrom, at least insofar as a driving connection therebetween is concerned, the clutch is free to reopen the gap between the flywheels and allow the ram to complete its cycle of movement by passing back therebetween under the influence of tension spring 30 connected thereto. In the particular form shown, the clutch actuating means comprises the nosepiece 26 which is mounted for retractble movement relative to the nozzle 28, and a rigid link 32 which operative connects the nosepiece to the pivoted frame 34 journalling the movable flywheel 16 for arcuate movement. As the nosepiece moves rearwardly into retracted position upon being pressed against a workpiece W in the manner shown in FIG. 7, link 32 acts upon the pivoted frame 34 to swing the movable flywheel rearwardly into engaged ram-driving relation. Once engaged, the ram cannot be released until it leaves the flywheels even if it were possible to return the nosepiece to its extended position during the few milliseconds it takes to complete the power stroke. Once the ram has, in fact, moved out of driving engagement therewith, the clutch is free to reopen the gap between the flywheels. This is accomplished automatically by a clutch release means connected to normally bias the pivoted frame 34 in a direction to open the gap between the flywheels. In the particular form shown, the clutch release means takes the form of a compression spring 36 normally biasing the retractable nosepiece 26 into extended position. Thus, before this particular clutch release means can function, the biasng force it exerts on the nosepiece must exceed the opposing retracting force exerted thereon by the workpiece W. As a practical matter, as soon as the ram has completed its work stroke, the operator will usually remove the nosepiece from engagement with the workpiece thus permitting the clutch release means to open the gap between the flywheels so spring 30 can retract the ram therebetween.

Figure 2:
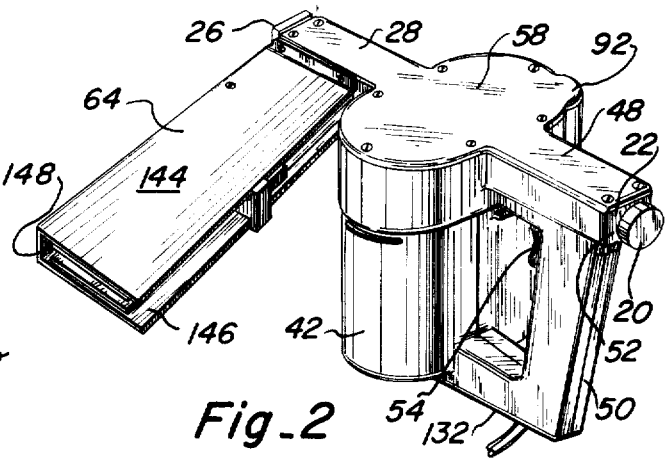
FIG. 2 is a perspective view of the tool as seen from a vantage point above and to the left of its rear end.
Figure 4:
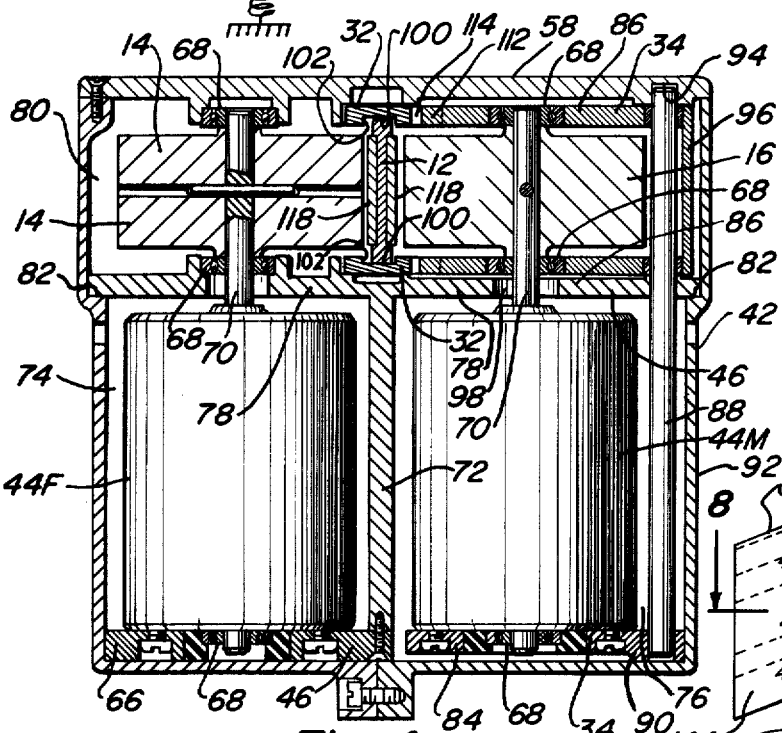
FIG. 4 is a transverse section taken along line 4—4 of FIG. 3 to a further enlarged scale.
Figure 3:
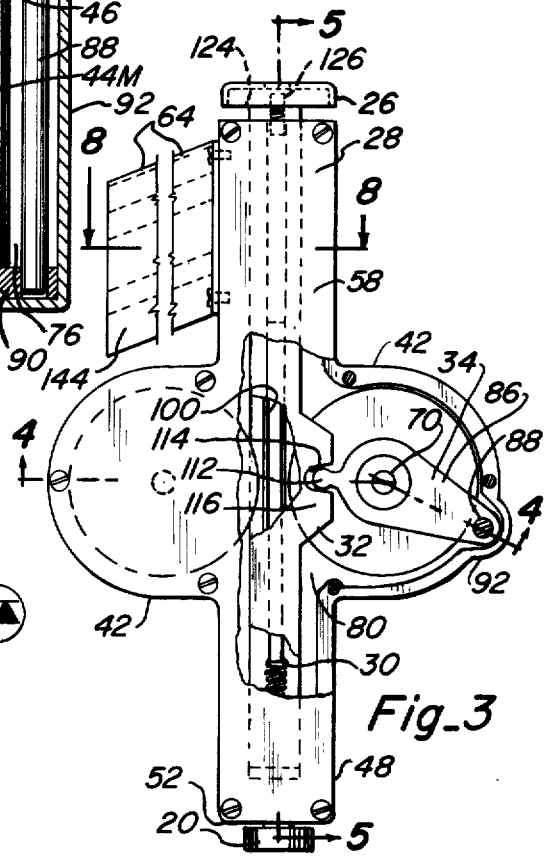
FIG. 3 is a top plan view of the tool to an enlarged scale, portions having been broken away to both conserve space and better reveal the interior construction.
Figure 5:
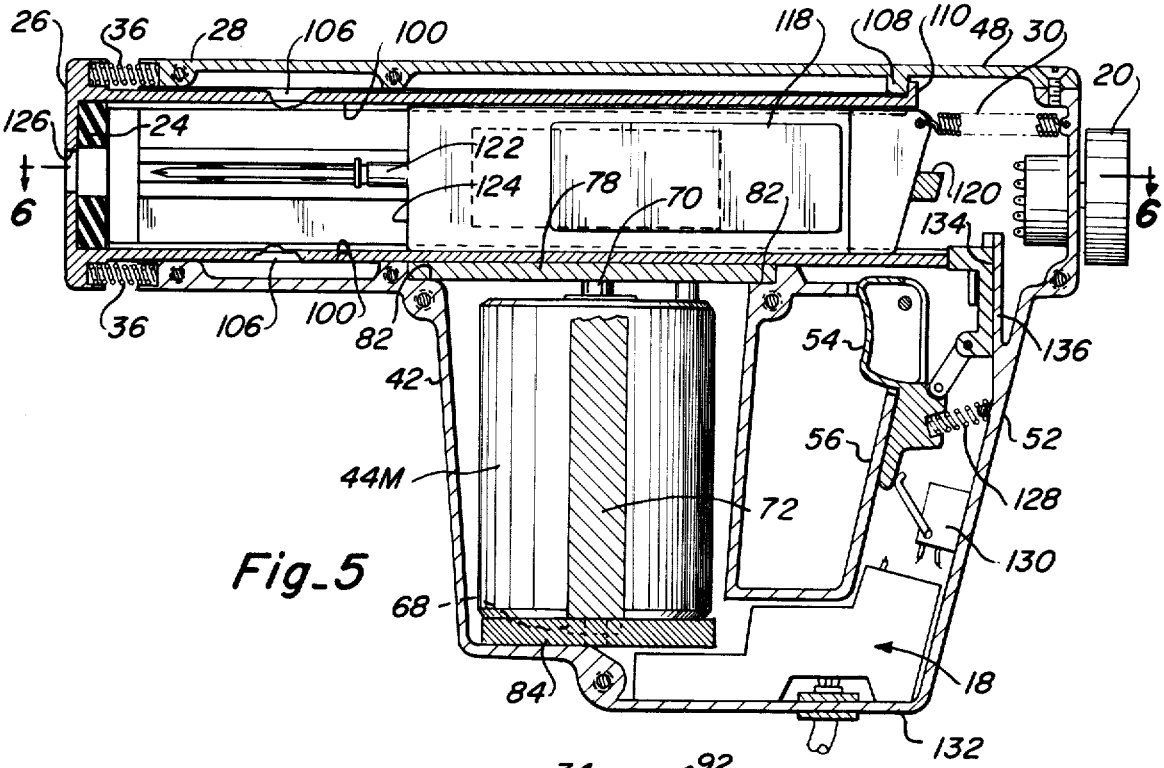
FIG. 5 is a longitudinal section to the same scale as FIG. 4 taken along line 5—5 of FIG. 3.
Figure 6:
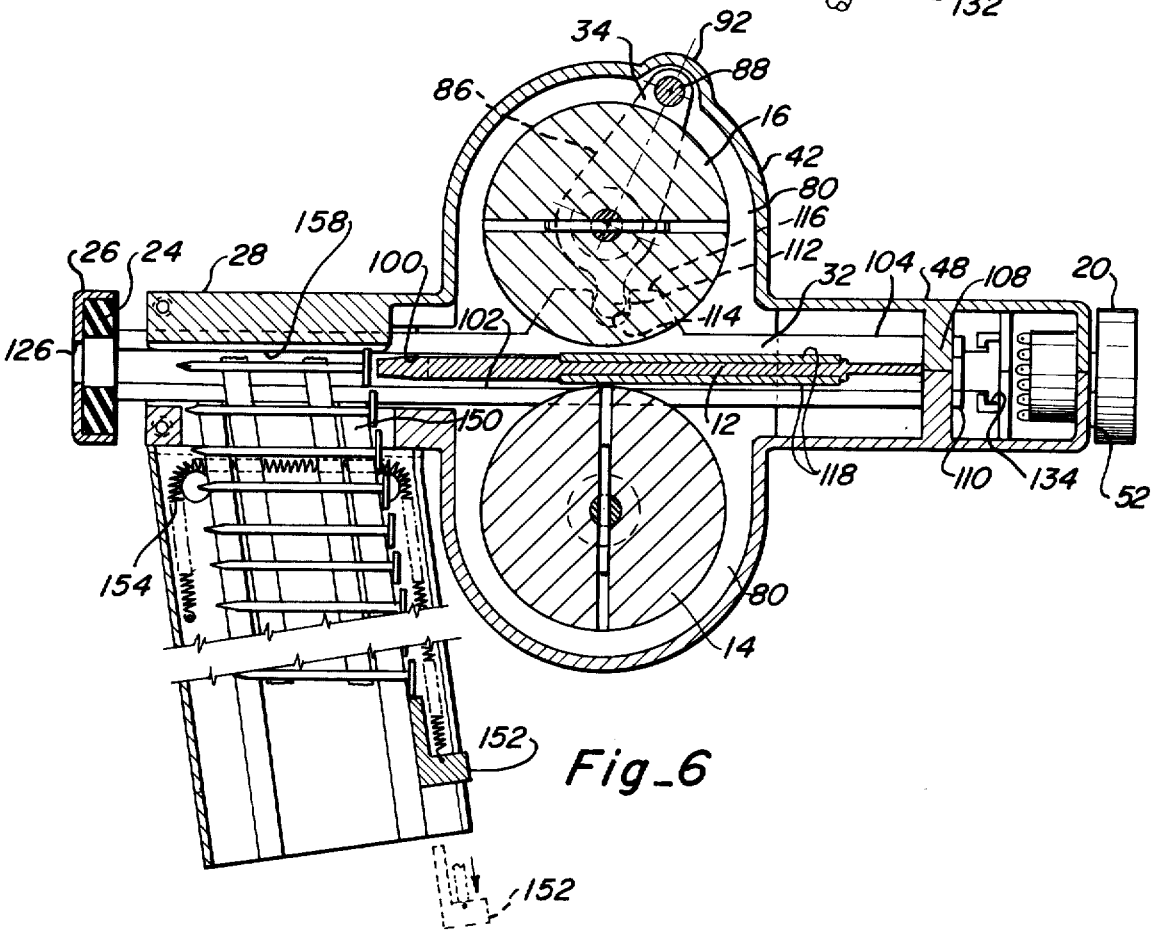
FIG. 6 is a section taken along line 6—6 of FIG. 5 and to the same scale as the latter figure, portions again having been broken away to conserve space.

Turning next to FIG. 2 where the nail-driving embodiment 10 of the tool has been shown in perspective, reference numeral 40 has been selected to designate the case or housing in its entirety, nozzle 28 forming a part thereof. Immediately behind the nozzle is an enlargement which will henceforth be referred to as the "flywheel cavity" 42 for lack of a better term. Within this cavity is housed the drive means in the form of a pair of identical electric motors 44, the movable mounting 34 for one of them, and the fixed mounting 46 for the other. Extending on rearwardly of the flywheel cavity as a integral part of the housing aligned longituidinally with the nozzle is the upper limb 48 of the handle 50. Limb 48 is hollow and adapted to receive the ram 12 in its retracted position as shown in FIGS. 5 and 6. In the particular form shown, speed selector switch 20 of th speed control 18 along with the scale 22 calibrated in nail sizes or the like are provided on the rearwardly-forcing wall 52 on the back of handle 50. The handle 50, as a whole, has the usual C-shaped configuration commonly associated with many electrically-driven hand tools. The handle 50 also carries the trigger 54 and the line cord 56 to the source of electrical power in the event a self-contained power source is not used.

As illustrated, the case has a removable cover plate 58 which provides access to the interior thereof and, in addition, it is shown die cast in two halves which are bolted together. The nail gun form of the tool, of course, requires an opening 60 (FIGS. 7, 8 and 9) into which the nails or other fasteners 62 are fed into the path of the advancing ram 12. A magazine 64 of conventional design has been shown feeding a commercially-available belt of nails into opening 60 in the side of the nozzle.

FIGS. 3–7, inclusive, to which reference will now be made, show the interior construction of the tool most clearly. Resting in the bottom of flywheel cavity 42 is a fixed endplate 66 which carries a bearing 68 journalling the shaft 70F of fixed motor 44F. An upstanding partition wall 72 divides the flywheel cavity into two motor compartments 74 and 76. A horizontal wall 78 formed integral with the partition wall 72 separates the motor compartments 74 and 76 from the flywheel compartment 80. The horizontal wall is shown supported on ledges 82 on the inside of the flywheel cavity. Additional shaft bearings 68 are mounted in fixed position in one half of the flywheel compartment, one being recessed in the top of the horizontal wall while the other is recessed into the lid. Fixed flywheel 14 is mounted on the portion of motor shaft 70F projecting from motor compartment 74 up into the flywheel compartment. Thus, the fixed motor 44F and its flywheel 14 are housed in one side of the flywheel cavity alongside ram 12.

Figure 7:
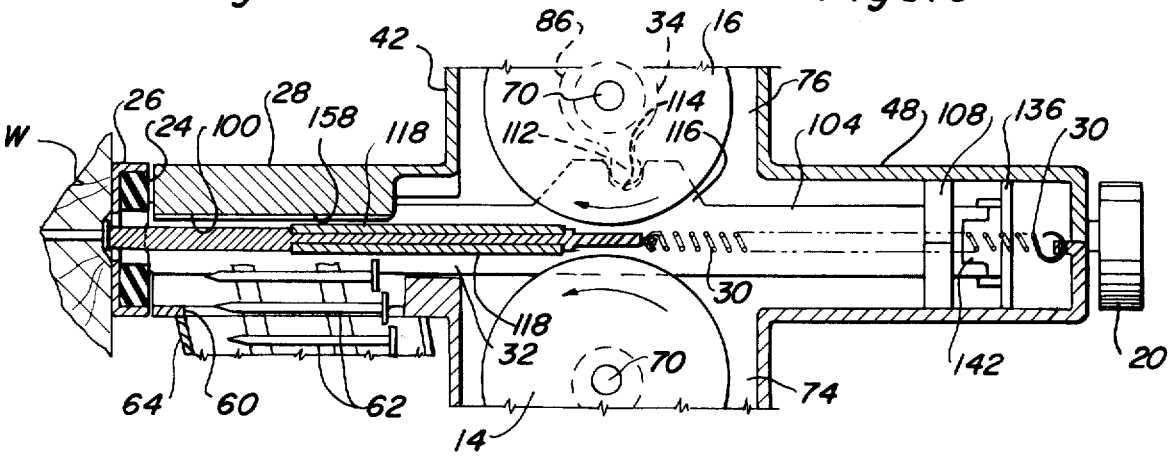
FIG. 7 is a fragmentary section similar to FIG. 6, but showing ram advanced into its fully-extended position.

In the other side of the flywheel cavity, is mounted movable motor 44M, its shaft 70M and movable flywheel 16. Fixed endplate 66 is replaced by movable endplate 84 that carries bearing 68 journalling the lower end of shaft 70M of the movable motor 44M. This endplate together with vertically-spaced parallel arms 86 cooperate to define the pivoted mounting means 34 that carries motor 44M and its flywheel for pivotal movement in a direction to vary the width of the gap so as to engage and form a driving connection with the ram. The lower end of pin 88 is non-rotatably fastened in an integrally-formed foot 90 provided on the underside of the movable endplate 88 which skids back and forth on the bottom of the housing. The housing is shown provided with an enlargement 92 to accommodate the pivot pin, the upper end of which is rotatably mounted in a socket 94 in the coverplate 58. As shown, arms 86 are joined together by a web 96 to define a unitary structure which is non-rotatably fastened to the pivot pin 88. These arms and movable endplate 84 each carry bearings 68 journalling the shaft 70 of motor 44M. An oversize aperture 98 in the horizontal wall 78 accommodates the shaft 70 of the movable motor and permits the entire pivoted mount 34 therefore to swing arcuately relative thereto between its engaged and disengaged positions. Note in FIGS. 1 and 3 that the axis of pivotal movement defined by the pivot pin 88 is located to the rear of the spin axis of the movable flywheel defined by movable motor shaft 70. Thus, even when fully engaged as shown in FIG. 7, the spin axis still lies well ahead of a plane passing through the axis of pivotal movement of the mount that is perpendicular to the path followed by the ram during its excursion into extended position or work stroke. As will be seen presently, the ram is loosely fitted for longitudinal slidable movement in the opposed track-forming grooves 100 of the clutch actuating means 32 so that it can move aside the fraction of an inch required to bring it into engagement with the fixed flywheel. Once thus engaged, however, the ram follows a straight-line path determined by the shoulders 102 of the tack-forming grooves or guideway remote from the movable flywheel that is urging the latter thereagainst. It is for this reason that the angle $\theta$ in FIG. 1 and the normal plane have been defined in terms of the forward excursion of the ram. The return stroke of the ram, while confined to the guideway, need not follow a straight line and, in fact, can be slightly canted therein.

Directing the attention next to FIGS. 3–11, inclusive, it can be seen that a pair of rearwardly-extending parallel arms 104 are attached to the rear face of the nosepiece 26 and mount same within the nozzle for limitd reciprocating movement between its normally extended position and a retracted one. These arms perform a dual function, the first of which is that of guiding the ram between its extended and retracted position due to the track-forming grooves 100 formed in the opposed surfaces thereof. Secondly, it is these same arms that are operatively linked to the arms 86 of the pivoted mount 34 and thus cooperates with the nosepiece to define the clutch actuating means 32.

These arms, while forming the guideway for the ram, are, in themselves, guided for limited reciprocating slidable movement in opposed grooves 106 formed on the underside of the lid 58 to the housing and the bottom walls of the nozzle 28 and upper handle limb 48 into which they telescope. In contrast to the ram 12, arms 104 are closely confined within the grooves 106 in the housing so that its movement is restricted to essentially straight-line motion.

Figure 11:
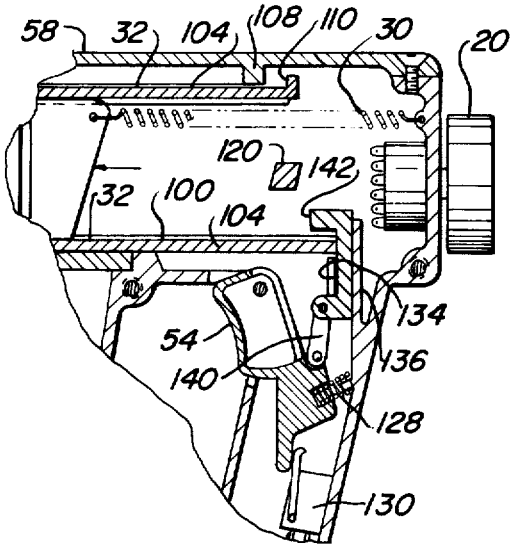
FIG. 11 is a fragmentary section like FIG. 10 except that the nosepiece is shown in retracted position; and, FIG. 12 is a schematic of a representative motor speed control circuit.
Figure 10:
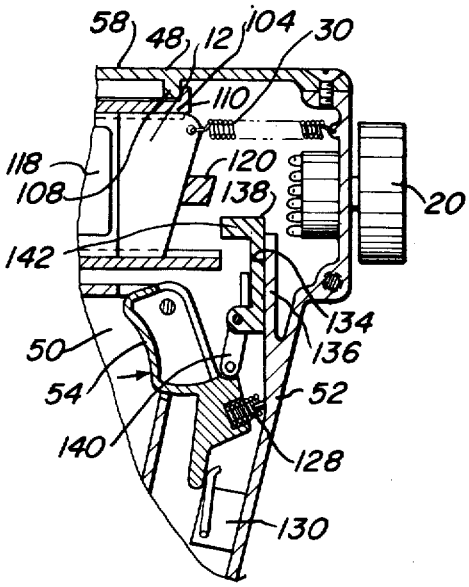
FIG. 10 is a fragmentary section similar to FIG. 5 and to the same scale as the latter showing the trigger actuated, but the nosepiece still extended.

As revealed most clearly in FIGS. 10 and 11, a fixed limit stop 108 provided on the underside of lid 58 engages a movable stop 110 carried by the upper arm 104 to limit the forward excursion of the clutch-actuating means 32. The rearward movement of the latter is stopped when the nosepiece 26 engages the front end of the nozzle. One or more compression springs 36 positioned between the opposed faces of the nozzle and nosepiece normally bias the latter into extended position. These springs constitute a clutch release mechanism automatically operative to disengage the clutch in a manner to be explained in detail presently as soon as the clutch actuating means 32 is deactuated by permitting the nosepiece to return to its normally-extended position.

Now, in FIGS. 3–7 it can be seen that the ends of arms 86 of the pivoted mount 34 remote from pivot pin 88 are provided with vertically-aligned ears 112 that are received in notches 114 formed in the boss 116 provided on one side of arms 104. The connection thus formed between the clutch actuating means 32 consisting of the nosepiece 26 and arms 104 operatively links the latter to the clutch means consisting of the flywheels and pivoted mount 34. As the clutch actuating means 32 is actuated by pressing the nosepiece against a workpiece with sufficient force to overcome the bias exerted thereon by springs 36 and retract same, it will swing the mounting means 34 rearward arcuately to close the gap separating the flywheels thus engaging the clutch by gripping the ram therebetween. As previously noted, once engaged, the clutch will remain so until the ram clears the flywheels as shown in FIG. 7. When this happens, the clutch can be disengaged and it will do so automatically under the influence of the clutch release springs 36 provided with clutch actuating means 32 has been deactuated. In other words, so long as the nosepiece remains pressed against the workpiece, ram retraction spring 30 will be pulling it back into contact with the flywheels, but they will not spread apart to allow it to pass therebetween. As soon as the pressure on the nosepiece is relieved to a point when the bias on the latter by clutch release springs 36 can extend it, the gap between the flywheels will reopen and the ram can complete its return stroke.

The flywheel engaging surfaces of the ram will both be seen to include friction pads 118 formed from some tough abrasion resistant material having are reasonably high coefficient of friction when placed in contact with a metal flywheel such as, for example, ordinary brake lining material. As ram retraction spring 30 biases the ram rearwardly, it strikes limit stop 120 shown in FIG. 5.

Figure 8:
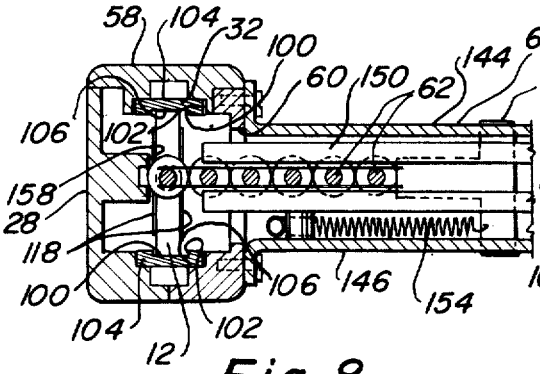
FIG. 8 is a fragmentary section taken along line 8—8 of FIG. 3 to an even further enlarged scale.
Figure 9:
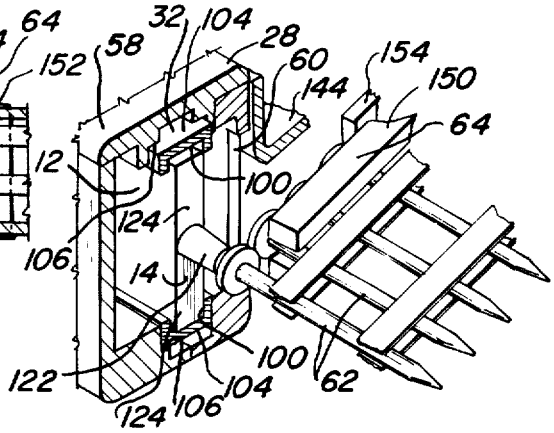
FIG. 9 is a fragmentary perspective view to the same scale as FIG. 8 and with portions broken away and shown in section to better reveal the interior construction.

The front end of the ram is shaped to define a nose 122 bordered both top and bottom by forwardly-facing shoulders 124 best seen in FIGS. 5, 8 and 9. The nose 122 passes through an aperture 126 sized to receive same in the nosepiece while the shoulders engage the shock-absorbing cushion 24 bordering the latter. Whatever energy is left in the ram at the completion of its workstroke is, hopefully, dissipated in this cushion, otherwise, the nose of the ram will impact against the workpiece itself.

Particular reference will next be had to FIGS. 5, 6, 7, 11 and 12 for a detailed description of the trigger 54 and an important safety interlock between the latter and the clutch actuating means 32. Trigger 54 is pivotally mounted within the opening in the handle in the usual manner and is normally biased forwardly by spring 128. As the trigger is manually actuated into retracted position it closes the normally-open on/off switch 130 in the motor speed control circuit 18, the latter having been shown located in the lower limb 132 of the handle.

A vertically disposed T-shaped slot 134 is formed integral with web 136 on the inside of the handle above the trigger. Mounted within this slot for limited vertically slidable movement is a limit stop 138 operatively connected to the trigger by link 140. As the trigger 54 is retracted into its actuated position, it acts through connecting link 140 to raise the stop 138 and move its forwardly-projecting abutment 142 from behind the lower arm 104, thus allowing the clutch actuating means 32 to move rearwardly so as to engage the clutch. With the trigger released, abutment 142 blocks the retraction of the nosepiece 26 which, as previously noted, is necessary to engage the clutch. Thus, if the tool is running and dropped on its nose by the operator, he will, of necessity, let go of the trigger thus interpositioning the abutment 142 and prevented the clutch from engaging which, otherwise, would have actuated the ram to discharge a nail.

In FIGS. 6, 7, 8 and 9, the magazine 64 will be seen to be of more or less conventional design including upper and lower parallelogram-shaped plates 144 and 146 connected along the front edge by a wall 148 that cooperates therewith to produce a rearwardly-opening channel. Tracks 150 spaced to receive the shanks of the nails 62 therebetween and hold same for slidable movement in alignment with the nose 122 of the ram are located just inside the opening in the rear edge. The nail heads butt up against this track and are advanced into position to be driven by a follower 152 which is pulled by a coiled tension spring 154.

The nails themselves are joined together to form a belt by paper tapes 156 in the conventional way as shown. The lead nail of the chain abuts a stop 158 inside the nozzle across from opening 60 that holds it in alignment with the nose of the ram. The second nail, on the other hand, is still held back by the track 150. Therefore, as the ram advances, it strips the lead nail from the belt and drives it on into the workpiece; whereupon, the follower moves the next nail into position to be driven as soon as the clutch actuating means is deactuated, the clutch release means opens the clutch, and the ram retraction spring pulls it back to clear the nozzle. To reload the magazine, the follower is pulled all the way out in much the same way a stapler is loaded. Since no novelty is predicated upon the magazine per se, a detailed description of its structural features would serve no useful purpose. The same is true of the motor speed control circuit of FIG. 12 which has no details identified other than those components which have mechanical significance in the tool itself.

In closing, it should be noted that while the tool shown is specifically designed for driving nail-like fasteners, it is by no means so limited and the ram can impact directly upon an external workpiece in the manner of a stamp, punch or chisel just as well as through the medium of a fastener. It can easily be seen that a tool having the following parameters is practical and, in addition, will perform adequately in any of the previously mentioned applications:

Flywheel Diameter: 3 inches
Flywheel Speed: 7000 r.p.m.
Ram Speed: 1000 in./sec.
Motor Horsepower: 1.125
Total Instrument Wt.: 10 lb.

What is claimed is:

1. An impact tool comprising: a housing having a forwardly-extending nozzle with an opening in the first end thereof communicating a flywheel cavity therebehind; ram means mounted within the housing for guided longitudinal slidable movement between a retracted position within the flywheel cavity and an extended position projecting into the nozzle; a substantially identical pair of flywheels journalled for rotation adjacent the ram means on opposite sides thereof about parallel axes normal to its direction of travel; drive means connected to the flywheels operative to turn them in opposite directions at substantially the same speed; pivoted mounting means journalling at least one of the pair of flywheels for relative arcuate movement in a direction to change the spacing therebetween, said mounting means cooperating with the flywheels and the drive means to define a clutch operative upon actuation to frictionally grip the ram means therebetween and propel same forwardly until it reaches a point where it is no longer in driving contact therewith; clutch actuating means connected to the mounting means operative upon actuation to shift the flywheels into ram-driving relation; clutch release means associated with the mounting means automatically operative to reopen the space between the flywheels immediately upon their becoming drivingly disengaged therefrom and upon deactuation of the clutch actuating means; and, ram return means connected to the ram means automatically operative to return same to its retracted position following actuation thereof into extended position and actuation of the clutch release means.

2. The impact tool as set forth in claim 1 in which: only one flywheel is arcuately movable about the axis of pivotal movement of the mounting means and the spin axis of the other of said flywheels is fixed; and, in which said arcuately-movable flywheel swings rearwardly into engaged position.

3. The impact tool as set forth in claim 1 which includes front stop means interposed in the path of the ram means operative to limit the forward excursion thereof.

4. The impact tool as set forth in claim 1 which includes a rear stop means interposed in the path of the ram means operative to stop same in retracted position.

5. The impact tool as set forth in claim 1 in which: the clutch actuating means comprises a nosepiece on the forward end of the nozzle mounted for movement relative thereto between an extended and a retracted position; and link means interconnecting said nosepiece and mounting means, said link means being operative to engage the clutch upon movement of the nosepiece into retracted position.

6. The impact tool as set forth in claim 1 in which: the clutch release means comprise a biasing member connected to normally urge the mounting means in a direction to disengage the clutch.

7. The impact tool as set forth in claim 1 in which: one of the flywheels is mounted for rotation about a fixed spin axis; and, in which the ram means is mounted for limited lateral movement to the extent necessary to place same in frictional engagement with the fixed flywheel.

8. The impact tool as set forth in claim 1 in which: means comprising a retractable stop is operatively associated with the clutch means for normally maintaining same in disengaged position; and, in which a manually-actuated trigger means is connected to the retractable stop operative upon actuation to retract same and release the clutch means for movement into engaged position.

9. The impact tool as set forth in claim 1 in which: the nozzle is provided with a second opening alongside the path of guided movement of the ram means defining a breach sized to accept a member to be driven, and means adjacent said second opening effective to receive and releasably retain said member to be driven in the path of the advancing ram means.

10. The impact tool as set forth in claim 1 in which: the drive means comprises at least one electric motor; and, in which means comprising a speed control is electrically connected to said motor effective upon actuation to vary the speed of flywheel rotation.

11. The impact tool as set forth in claim 1 in which: the length of the ram means is so related to the location of the clutch means that the former element will have moved forwardly into a position out of driving engagement with the latter before reaching the end of the nozzle.

12. The impact tool as set forth in claim 1 in which: the drive means comprises a pair of electric motors connected to drive the flywheels independently of one another in opposite directions at substantially the same speed.

13. The impact tool as set forth in claim 1 in which: only one of the flywheels is mounted for arcuate movement relative to the ram means and the other is journalled for rotation about a fixed spin axis; the mating surfaces of the flywheels and ram means are shaped to make straight-line tangential contact with one another paralleling their spin axes; and, in which the spin axis of the arcuately movable flywheel cooperates with the axis of pivotal movement of the mounting means to define a plane that intersects a second plane perpendicular to the direction of travel of the ram means at an acute angle whose tangent is equal to or less than the coefficient of friction between the contacting surfaces of the latter element and said arcuately-movable flywheel.

14. The impact tool as set foth in claim 2 in which: the mating surfaces of the ram means and flywheels make tangential contact with one another along lines paralleling the axes of rotation of the latter; and, in which the axis of pivotal movement of the mounting means and the spin axis of the arcuately-movable flywheel journalled therein are so related to one another and to said line of tangential contact of said flywheel with the ram means when in driving engagement therewith that said spin axis stops ahead of the plane defined by the other two.

15. The impact tool as set forth in claim 2 in which: the mounting means, arcuately movable flywheel journalled therein and ram means are so positioned relative to one another when the latter two elements are drivingly engaged that a plane perpendicular to the direction of travel of the ram means into extended position will intersect a second plane defined by the spin axis of the arcuately-movable flywheel and the axis of pivotal movement of the mounting means at an acute angle; and, in which the coefficient of friction between the contacting surfaces of the ram means and arcuately-movable flywheel at least equals in magnitude the tangent of said acute angle as thus defined.

16. The impact tool as set forth in claim 3 in which: the front stop means comprises a cushioned abutment in the forward extremity of the nozzle, said abutment being effective to absorb and dissipate a substantial portion of any excess energy carried by the advancing ram means prior to its contacting a workpiece located in front of the nozzle.

17. The impact tool as set forth in claim 4 in which: the rear stop means is so located as to stop the ram means in retracted position such that the clutch means will initially engage the latter adjacent the front end thereof.

18. The impact tool as set forth in claim 14 in which: the length of the ram means relative to the location of the clutch is such that the former element is no longer in driving engagement with the latter by the time the front end thereof reaches the forward end of the nozzle.

19. The impact tool as set forth in claim 14 in which: the tangent of the angle is less than the coefficient of friction.

20. The impact tool as set forth in claim 15 in which: the ram means and flywheels are shaped such that their mating surfaces make essentially straight-line tangential contact with one another along lines paralleling the spin axes.

21. The impact tool as set forth in claim 15 in which: the coefficient of friction exceeds the tangent of the acute angle.

22. The impact tool as set forth in claim 15 in which: the spatial relationship between the elements is such that the ram means becomes disengaged from the clutch means in advance of its reaching the front end of the nozzle.

23. An impact tool for applying desired impact forces to an impact receiving object comprising:

a housing defining a drive path;

a flywheel having a peripheral edge and mounted on said housing;

means for rotating said flywheel;

elongate ram means having a rear end, an impacting end, and a side, said ram being mounted in said housing for movement toward and away from said impact receiving object from a repose position in which a central portion of said ram side is located immediately adjacent said flywheel peripheral edge and said rear end is spaced apart therefrom, into an impacting position in which said ram rear end is located immediately adjacent said flywheel peripheral edge;

means supporting at least one of the ram means and flywheel for movement relative to the other from normal spaced positions to an operating position with the side of said ram means engaged against the periphery of said flywheel in a tangential manner;

control means for moving said flywheel and ram means into driving engagement to move said ram means along said drive path in a direction toward said impact receiving object to apply a desired impact force thereto;

and retraction means for moving said ram means away from said impact receiving object upon disengagement of said flywheel.

24. The tool of claim 23, said flywheel being movable toward said ram means in a direction having a first component normal to the movement of said ram means in a drive stroke, and a second component opposed to the movement of said ram means in a drive stroke.

25. The tool of claim 24, said support means comprising a lever extending between the rotational axis of said flywheel and a pivot axis substantially spaced from a plane normal to said drive path and passing through said rotational axis.

26. An impact tool for applying an impact to an impact receiving object, elongate ram means mounted for movement in the direction of its length and having a friction surface with a given coefficient of friction on one side thereof, a rotating body for storing energy to be imparted to the ram means mounted alongside the latter for rotational movement about an axis perpendicular to its direction of movement, and a clutch means for coupling the rotating body to the friction surface of the ram means, said clutch means including means mounting said rotating body for pivotal movement toward the ram means about a pivot point spaced on the other side of said axis of rotation of the rotating body from the ram means.

27. An impact tool for applying an impact to an impact receiving object, a ram means mounted for movement along a path and having a friction surface with a given coefficient of friction, rotating body for storing energy to be imparted to the ram means, a clutch means for coupling the rotating body to the friction surface of the ram means, said clutch means including means mounting said rotating body for pivotal movement toward the ram means about a pivot point spaced on the other side of the axis of rotation of the rotating body from the ram means, and wherein said given coefficient of friction and the tangent of the acute angle formed by a line generally perpendicular to said path and a line passing through the axis of rotation of the rotating body and said pivot point are generally the same.

28. A portable hand tool comprising a housing, a work performing means carried on the housing, a power unit on the housing coupled to the work performing means and for operating the work performing means, said power unit including at least one balance rotating body of a mass and rotating in one direction at a speed sufficient to provide a gyroscopic precession of the housing.

and a further balanced rotating body on the housing rotating in a direction opposite to said one direction and having a speed and mass sufficient to generally nullify said gyroscopic precession of said housing.

29. A portable hand tool as set forth in claim 28 wherein the power unit and the further rotating body includes a pair of counterrotating flywheels.

30. A portable hand tool as set forth in claim 29 wherein the power unit includes a pair of rotating motors each coupled to one of the flywheels.

31. A portable hand tool as set forth in claim 28 wherein both the one and the further rotating body are coupled to the work performing means.

32. An impact tool for applying an impact to an impact receiving object, elongate ram means mounted for movement in the direction of its length and having a ram surface on one side thereof, a rotating body for storing energy to be imparted to the ram means mounted alongside the latter for rotational movement about an axis perpendicular to its direction of movement, clutch means for coupling the rotating body to the ram surface of said ram means and friction material drivingly associated between said rotating body and said ram surface, and said clutch means including means mounting said rotating body for pivotal movement toward the ram means about a pivot point spaced on the other side of said axis of rotation of the rotating body from the ram means.

33. An impact tool for applying desired impact forces to an impact receiving object comprising:

a housing defining a drive path;

ram means mounted for reciprocal movement in said drive path toward and away from said impact receiving object;

a first flywheel;

means for rotating said first flywheel;

a counterrotating flywheel supported on the opposite side of said ram means from said first flywheel;

support means supporting said first flywheel in a normal position adjacent to and spaced from said ram means, said support means being movably mounted;

and means for moving said support means to move said first flywheel into driving engagement with said ram means to move said ram means along said drive path in a direction toward said impact receiving object to apply a desired impact force thereto.

34. The tool of claim 33, said counterrotating flywheel having a rotational axis fixed relative to said drive path.

* * * * *